United States Patent [19]

Ricks et al.

[11] 4,366,034

[45] Dec. 28, 1982

[54] HARD CHROMIUM PLATING PROCESS FOR COBALT-CHROMIUM-TUNGSTEN ALLOYS

[75] Inventors: Herbert E. Ricks, Sarasota, Fla.; Edward F. Sverdrup, North Huntingdon, Pa.

[73] Assignee: Westinghouse Electric Corp., Pittsburgh, Pa.

[21] Appl. No.: 270,459

[22] Filed: Jun. 4, 1981

[51] Int. Cl.[3] ..... C25D 5/38

[52] U.S. Cl. ..... 204/32 R; 204/51

[58] Field of Search ..... 204/32 R, 51, 141.5

[56] References Cited

U.S. PATENT DOCUMENTS

| | | | |
|---|---|---|---|
| 2,849,348 | 8/1958 | Gray | 204/1.5 |
| 2,992,171 | 7/1961 | MacLean | 204/51 |
| 3,328,271 | 6/1967 | Kneip, Jr. et al. | 204/32 |
| 3,446,715 | 5/1969 | Frey | 204/32 |
| 3,573,120 | 3/1971 | Waldrop et al. | 156/18 |

*Primary Examiner*—Winston A. Douglas
*Assistant Examiner*—William Leader
*Attorney, Agent, or Firm*—R. A. Stoltz

[57] ABSTRACT

This is a process for providing good adhesion of chromium electroplated onto a chromium and tungsten containing cobalt alloy (comprising 40–60% by weight cobalt, 19–25% chromium and 10–20% tungsten). Prior to electroplating, the cobalt alloy surface is etched with a 1–45% ferric solution for 1–200 minutes at 10°–100° C. Preferably, the surface is cleaned with an alkaline solution prior to etching and rinsed with cold water after etching.

6 Claims, No Drawings

HARD CHROMIUM PLATING PROCESS FOR COBALT-CHROMIUM-TUNGSTEN ALLOYS

BACKGROUND OF THE INVENTION

In many environments, it is desirable to electroplate chromium onto cobalt-based alloy. One such application is the nose shields on induced draft fans operating in coal fired power plants. As such fans are often subjected to excessive fly-ash erosion, the economic loss due to plant shut-downs because of frequent fan blade protective shield replacements is high, and performance of the fans with regard to erosion is often unsatisfactory. While a nose shield of Haynes alloy 25 (approximately 10% nickel, 20% chrome, 15% tungsten, 3% iron, 0.1% carbon, 1% silicon, 1.5% manganese, 0.03% phosphorus, 0.03% sulfur and the balance essentially cobalt) plated with 30 mils of hard chromium was most promising from an erosion standpoint, the adhesion of chromium plate by any conventional plating processes was unsatisfactory and significant flaking resulted.

Heavy chromium deposits used in industrial or hard chrome plating applications such as this require essentially perfect adhesion to the base metal. Good adhesion of plating to carbon steel requires activation by reverse etching in the chrome plating solution. Stainless steels (18/8 type) require mechanical cleaning and activation in a fluoride or chloride solution prior to chrome plating. Conventionally refractory alloys such as Haynes alloy 25 have been treated with HCl, sulfuric acid or nitric acid prior to chrome plating, but poor adhesion has resulted.

SUMMARY OF THE INVENTION

This is an improved process for electroplating chromium onto a chromium and tungsten containing cobalt alloy with very good adhesion. (Heretofore, chrome plated cobalt based materials were generally impractical because of adhesion problems.)

The surface is preferably first cleaned with an alkaline solution. It is etched with a 1–45% ferric chloride solution for 1–200 minutes at 10°–100° C. Preferably, the etching is done at a temperature of 80°–90° C.

DESCRIPTION OF THE PREFERRED EMBODIMENTS

Conventionally refractory alloys such as Haynes alloy 25 (see Table I, below for composition) have been treated prior to plating by grit blasting or reverse etching in acids. Of the reverse etching in acids process, sulfuric acid has been shown to be as good as, or better than either hydrochloric or nitric acid, and sulfuric acid was used in the test summarized below.

TABLE I

Chemical Composition, Percent, Haynes Alloy No. 25

| Nickel | Cobalt | Chromium | Tungsten | Iron | Carbon | Silicon | Manganese | Phosphorus | Sulfur |
|---|---|---|---|---|---|---|---|---|---|
| 9.00–11.00 | Balance | 19.00–21.00 | 14.00–16.00 | 3.00 Max | 0.05–0.15 | 1.00 Max | 1.00–2.00 | 0.030 Max | 0.030 Max |

Table II shows test results of 90° bend testing and ball-peen testing of specimens with different pretreatments. Specimen 1B was anodically etched in sulfuric acid. Specimen 2B was a grit blasted. Specimen 3B received a ferric chloride etch pretreatment.

TABLE II

Adhesion Tests of Chromium Plated Haynes Alloy No. 25

| Specimen No. (pretreatment) | 90° Bend Test | Ball Peen Test |
|---|---|---|
| 1B (grit blasted) | Failed by flaking | Failed by flaking |
| 2B (sulfuric acid) | Failed by flaking | Failed by flaking |
| 3B (ferric chloride) | Passed-no flaking | Passed-no flaking |

Only by using the ferric chloride pretreatment (3B) was satisfactory adhesion obtained. Poor adhesion of chromium plate was obtained when the conventional pretreatments such as grit blasting or reverse etching in acid (2B) were used prior to the chromium plating solution. It is felt that the poor results using the conventional techniques is due to the tendency of the alloy to form very tenacious passive films of the oxides and/or poly-acids of the alloy agents. These oxides and/or poly-acids act as stripping agents and prevent good adhesion of the chromium plate to the base metal. it is felt that the ferric chloride etching provided good adhesion because chlorides were formed (rather than oxides and/or poly-acids) and that the very soluble metal chlorides could then be removed by a cool less than 90° F. water rinse to produce a clean active surface which provided a good bonding surface for the chromium plate.

High quality chromium plate having excellent adhesion to chromium and tungsten containing cobalt-based alloys (comprising 40–60% cobalt, 19–25% chromium, and 10–20 % tungsten) were obtained using the following process:

1. Vapor degrease
2. Alkaline clean in the following solution:
   $Na_2CO_3$:45 grams per liter
   $Na_3PO_4$:30 g/l
   NaOH:15 g/l
   Temperature:93° C. or 200° F.
   Time:5 minutes
3. Cold water rinse
4. Cold water rinse
5. Etch for 20 minutes in 500 g/l $FeCl_3$ at 70° C.
6. Cold water rinse
7. Cold water rinse
8. Plate in
   $CrO_3$:250 g/l
   $H_2SO_4$:2.5 g/l
   Temperature: 55° C.
   Current density—3 amperes per square inch
   Plating rate 0.006" per hour
9. Cold water rinse
10. Hot water (90° C.) rinse
11. Air dry As noted with respect to Table II, this process provides good coatings while similar processes with the substitution of either a grid blasting or a sulfuric acid anodic etching (in place of the ferric chloride etch) do not.

Etching time and temperature are, of course, related. Preferably, the ferric chloride etching is at a temperature of 60°–90° and is performed for 10–30 minutes. Similarly, the time and temperature are related to the strength of the ferric chloride solution. A 30–45% ferric chloride solution is preferred.

While the pre-etch cleaning can be performed in a number of manners, the alkaline cleaning followed by a cold water rinse has proven very satisfactory. One or more water rinses after the ferric chloride etching will, of course, extend the life of the plating solutions.

Ferric chloride has occasionally been used etching prior to plating. Frey, in U.S. Pat. No. 3,446,715 (May 27, 1969) teaches an alkaline solution treatment followed by a ferric chloride etch for zinc alloys prior to copper plating. Waldrop, in U.S. Pat. No. 3,573,120 (Mar. 30, 1971) shows a ferric chloride etch prior to electroplating nickel onto a uranium alloy. It has apparently not been used as a preplating treatment for cobalt alloys, or to provide a surface for chromium plating.

The invention is not to be construed as limited to the particular forms described herein, since these are to be regarded as illustrative rather than restrictive. The invention is intended to cover all processes which do not depart from the spirit and scope of the invention.

We claim:

1. In a process for electroplating chromium onto the surface of a cobalt-based metallic substrate, wherein said substrate comprises 40–60% cobalt, 19–25% chromium, 10–20% tungsten, the improvement which comprises:

etching said surface in a ferric chloride solution prior to said electroplating, said ferric chloride etching being with a 1–45% ferric chloride solution for 1–200 minutes at 10°–100° C.

2. The process of claim 1, wherein said etching is at a temperature of 60°–90° C.

3. The process of claim 2, wherein said etching is for 10–30 minutes.

4. the process of claim 3, wherein said etching solution is 30–45% ferric chloride.

5. The process of claim 4, wherein said substrate is cold water rinsed immediately after said etching.

6. The process of claim 5, wherein said substrate is cleaned with an alkaline solution prior to etching.

* * * * *